US006505451B1

(12) United States Patent
Ksajikian

(10) Patent No.: US 6,505,451 B1
(45) Date of Patent: Jan. 14, 2003

(54) INTERCONNECTING PLATE SYSTEM AND METHOD AND STRUCTURES FORMED THEREWITH

(75) Inventor: George Ksajikian, 1035 Camann St., Glendale, CA (US) 91208

(73) Assignee: George Ksajikian, Glendale, CA (US)

( * ) Notice: Subject to any disclaimer, the term of this patent is extended or adjusted under 35 U.S.C. 154(b) by 0 days.

(21) Appl. No.: 09/598,587

(22) Filed: Jun. 21, 2000

(51) Int. Cl.[7] ..... E04D 1/00

(52) U.S. Cl. ..... 52/518; 52/543; 52/519; 52/528; 52/545; 52/536

(58) Field of Search ..... 52/518, 543, 519, 52/528, 536, 539, 545, 546, 547, 522, 529

(56) References Cited

U.S. PATENT DOCUMENTS

| | | | | | |
|---|---|---|---|---|---|
| 1,204,885 | A | * | 11/1916 | Koerner | 52/519 |
| 1,575,974 | A | * | 3/1926 | Conway | 52/593 |
| 1,666,046 | A | * | 4/1928 | Heppes | 52/519 |
| 1,819,717 | A | * | 8/1931 | Mangano | 52/593 |
| 1,993,163 | A | * | 3/1935 | Harshberger | 52/519 |
| 1,993,164 | A | * | 3/1935 | Harshberger | 52/519 |
| 2,820,535 | A | * | 1/1958 | Hutchison | 52/520 |
| 3,233,382 | A | * | 2/1966 | Gravely, Jr. | 52/593 |
| 3,269,075 | A | * | 8/1966 | Marini et al. | 52/593 |
| 3,347,001 | A | * | 10/1967 | Cosden | 52/593 |
| 3,703,062 | A | * | 11/1972 | McKinney | 52/545 |
| 4,432,181 | A | * | 2/1984 | Funaki | 52/459 |
| 5,613,337 | A | * | 3/1997 | Plath et al. | 52/533 |
| 5,657,603 | A | * | 8/1997 | Goodhart et al. | 52/519 |
| 5,799,460 | A | * | 9/1998 | Jensen | 52/530 |
| 5,946,876 | A | * | 9/1999 | Grace, Sr. et al. | 52/520 |
| 6,000,185 | A | * | 12/1999 | Beck et al. | 52/520 |
| 6,029,415 | A | * | 2/2000 | Culpepper et al. | 52/522 |
| 6,269,603 | B1 | * | 8/2001 | Ross | 52/520 |

* cited by examiner

*Primary Examiner*—Lanna Mai
*Assistant Examiner*—Dennis L. Dorsey
(74) *Attorney, Agent, or Firm*—Foley & Lardner

(57) ABSTRACT

Systems and methods of connecting plates form structures such as roof coverings, awnings, wall coverings, floor coverings, ceiling coverings, decorative sculptures and the like. Each plate is configured to connect to at least one adjacent plate to form a structure of interconnected plates. Fastening surfaces are provided for securing the structure of interconnected plates to a further structure, such as a roof, a wall or framework of, for example, a window or door awning. Each plate has edges that are folded over toward opposing sides of the plate. The folded-over edges form channels on opposite facing sides of the plate which receive folded-over edges of other plates to. connect the plates together in a structure of interconnected plates. The plates may be rectangular, square, trapezoidal or triangle shaped.

14 Claims, 4 Drawing Sheets

INTERCONNECTING PLATE SYSTEM AND METHOD AND STRUCTURES FORMED THEREWITH

FIELD OF THE INVENTION

The present invention relates, generally, to systems and methods employing interconnecting plates which, when interconnected, form structures, and also to the structures formed with such systems and methods, including, but not limited to, roof coverings, awnings, wall coverings, floor coverings, ceiling coverings, decorative sculptures and the like.

SUMMARY OF THE DISCLOSURE

The present invention relates generally to systems of interconnecting plates and methods of connecting plates to form structures. Further embodiments of the invention relate to structures formed with such interconnecting plates. Such structures may include, but are not limited to, roof coverings, awnings, wall coverings, floor coverings, ceiling coverings, decorative sculptures and the like.

Systems according to embodiments of the invention include building systems composed of a plurality of interconnecting plates. Each plate is configured to connect to at least one adjacent plate to form a structure of interconnected plates. In preferred embodiments, means are provided for securing the structure of interconnected plates to a further structure, such as a roof, a wall or framework of, for example, a window or door awning.

In one preferred embodiment, each plate has a generally rectangular configuration with two folded-over edges. More particularly, each plate has a first edge that is folded over one facing side of the plate and an opposite edge that is folded over the other facing side of the plate. The folded-over edges form channels on opposite edges and opposite facing sides of the plate.

With the plates oriented such that the folded-over edges are at the top and bottom of each plate, a first plurality of plates may be interconnected, side-by-side, by partially overlapping adjacent plates and fitting folded-over edges of plates into channels of adjacent plates. A second plurality of plates may be similarly interconnected together and may be interconnected to the first plurality of plates, by overlapping the top folded-over edges of the second plates with the bottom folded-over edges of the first plates. Further plates may be interconnected to the top or bottom edges, as well as the side edges of the array of interconnected plates, to add to and become part of the array. In this manner, arrays of interconnected plates may be configured in varieties of shapes and dimensions.

Preferred configurations of the first embodiment include means for coupling an array of interconnected plates to a further structure, such as, but not limited to, a roof, a wall, a frame or the like. According to one preferred configuration, at least one connecting strip is connected to the array. The connecting strip provides a fastening surface which may be hidden from view and to which a fastening device, such as a nail, screw, bolt, or the like, may be secured, for securing the array to a further structure. The connecting strip has a folded-over edge extending in its lengthwise dimension and a fastening surface along the opposite lengthwise edge. The fastening surface may be provided with one or more apertures through which a screw, nail or bolt shaft may pass for securing the array to a further structure.

The connecting strip connects to the array by fitting the folded-over edge of the connecting strip into the channel formed by the folded-over bottom or top edges of the first plurality of side-by-side interconnected plates. The connecting strip is fitted into the channel of the first plurality of plates and is secured to the further structure, prior to fitting the folded-over edges of the second plurality of plates into the channel. In this manner, the second plurality of plates, when fitted into the channel, will cover the connecting strip from view.

In a second preferred embodiment, each plate has a generally triangular configuration, with folded-over edges. More particularly, one "first" edge of the triangular plate is folded over a first facing side of the plate, while two "second" edges of the triangular plate are both folded over the opposite facing side of the plate. The folded-over edges form channels on each of the three edges and on opposite facing sides of the plate.

With a first one of the triangular plates oriented such that the first edge (the only edge folded-over the first facing side of the plate) defines the bottom edge, the plate may be considered to be pointing upward relative to the first edge. A second plate, pointing downward relative to its first edge, may be connected to the first plate, by overlapping one of the second folded-over edges of the second plate with one the second folded-over edges of the first plate. A third plate, pointing upward relative to its first edge, may be connected to the array, by overlapping one of the second folded-over edges of the third plate with the free folded-over edge of the second plate. Additional plates may be added to the array in a similar fashion. Yet further plates may be coupled to the array by overlapping the folded-over first edges of the further plates with the folded over first edges of plates in the array. Such further plates may also be coupled to each other in the fashion described above with respect to the first, second and third plates of the array. In this manner, arrays of interconnected triangular plates may be configured in varieties of shapes and dimensions.

Preferred configurations of the second embodiment also include means for coupling an array of interconnected plates to a further structure, such as, but not limited to, a roof, a wall, a frame or the like. According to one preferred configuration, a fastening surface is provided adjacent the corner between the two second edges of at least some of the triangular plates. Fastening devices, such as, but not limited to, nails, screws, bolts or the like, may be secured to the fasting surface, for securing the array to a further structure. For example, one or more apertures may be provided in the fastening surfaces, through which a screw, nail or bolt shaft may pass.

In accordance with each of the above embodiments, arrays of interconnected plates may be configured to the dimensions of, for example, roofs or walls, to form decorative and/or protective roofing or wall panels. As another representative example, arrays of interconnected plates may be configured to the dimension of awnings to form decorative and/or protective awning coverings. In yet further examples, arrays of plates may be interconnected to form decorative, artistic sculptures. The overlapping arrangement of the plates, when interconnected, can provide an aesthetically pleasing design, as well as a protective covering for a roof, wall or other structure.

Accordingly, embodiments of the invention include systems composed of a plurality of interconnectable plates configured as described above. Further embodiments of the invention include structures formed of systems of interconnected plates as described above. Yet further embodiments of the invention include processes of making and using systems of interconnected plates as described above.

BRIEF DESCRIPTION OF THE DRAWINGS

Referring now to the drawings in which like reference numbers represent corresponding parts throughout.

DETAILED DESCRIPTION OF PREFERRED EMBODIMENTS

Figure 2:
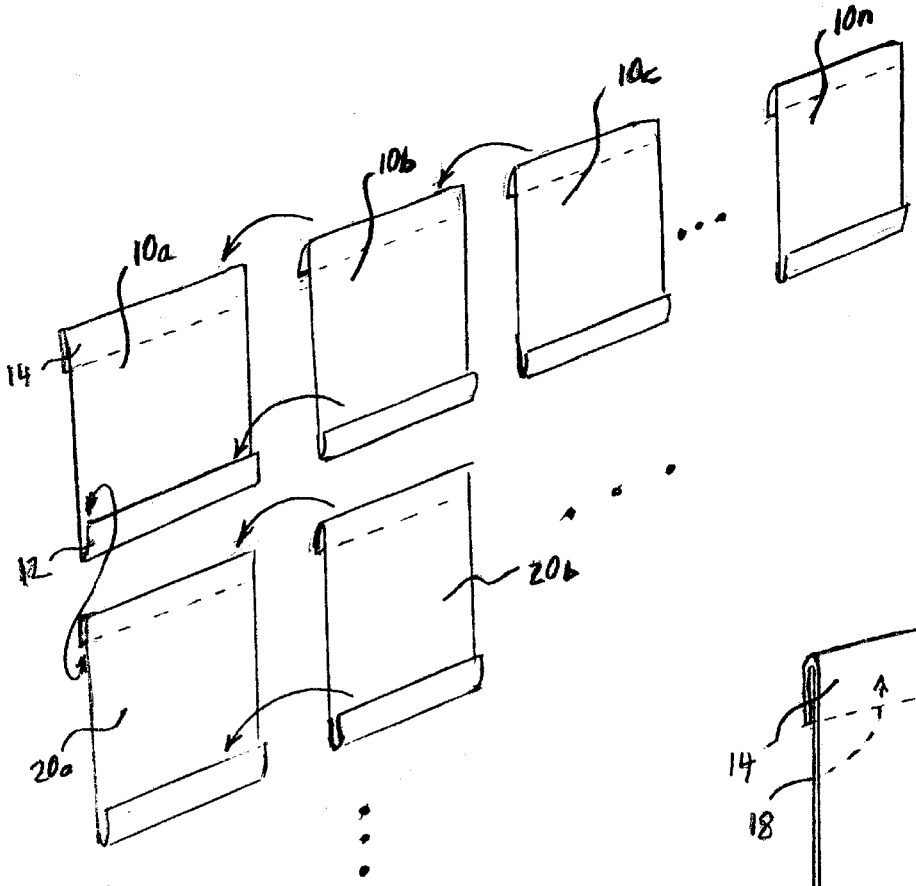
FIG. 2 is a schematic representation of an interconnection scheme for a plurality of plates of the type shown in FIG. 1.

The following detailed description is of the best presently contemplated mode of implementing the invention. This description is not to be taken in a limiting sense, but is made merely for the purpose of illustrating the general principles of the invention. The scope of the invention is best defined by the appended claims.

As discussed above, the present invention relates generally to systems of interconnecting plates and methods of connecting plates to form structures. Further embodiments of the invention relate to structures formed with such interconnecting plates. Such structures may include, but are not limited to, roof coverings, awnings, wall coverings, floor coverings, ceiling coverings, decorative sculptures and the like.

Systems according to embodiments of the invention include building systems composed of a plurality of interconnecting plates. Each plate is configured to connect to at least one adjacent plate to form a structure of interconnected plates. In preferred embodiments, means are provided for securing the structure of interconnected plates to a further structure, such as a roof, a wall or framework of, for example, a window or door awning. Systems may be packaged, sold or distributed as kits comprising a plurality of plates suitable for forming specific structures. Thus, for example, an awning kit may be packaged with a specific number of plates, instructions and other suitable components for constructing an awning. Alternatively, systems may be packaged, sold or distributed as individual plates or by groups of plates, for example, groups of 10, 100 or 1000 plates, for any suitable building project.

In preferred embodiments, the plates are composed of an aesthetically pleasing and durable material, such that structures formed by arrays of interconnected plates will be durable and aesthetically pleasing. For example, preferred embodiments include plates composed of metal materials, such as copper, brass, stainless steel or alloys thereof. However, in further embodiments, plates may be composed of other suitable materials including, but not limited to plastic, fiberglass or other composite material or metals other than those noted above.

As described in more detail below, the plates are configured with "folded-over" edges to provide interconnection capabilities. These plate configurations may be made according to any suitable manufacturing process. In preferred embodiments, the plates are composed of sheets of metal material, such as the preferred metals noted above, which are cut into appropriate shapes and bent into the appropriate configurations, using standard sheet metal bending techniques. However, other embodiments may employ other suitable techniques for forming the "folded-over" plate configurations, including, but not limited to extruding, molding, machining or the like.

A plate configuration and structures formed of such interconnected plates according to a first embodiment of the invention are shown and described with reference to FIGS. 1–4. A plate 10*a* according to the first preferred embodiment in FIG. 1, has a generally rectangular configuration with two folded-over edges. More particularly, the plate 10*a* has a first edge 12 that is folded over one facing side of the plate (the side facing outward from the page in FIG. 1) and an opposite edge 14 that is folded over the other facing side of the plate (the side facing into the page in FIG. 1). The portion of the folded over edge 14 which is out of view behind the plate 10*a* is shown in broken lines in FIG. 1. The folded-over edges form channels 16 and 18, respectively, on opposite edges and opposite facing sides of the plate.

Figure 1:
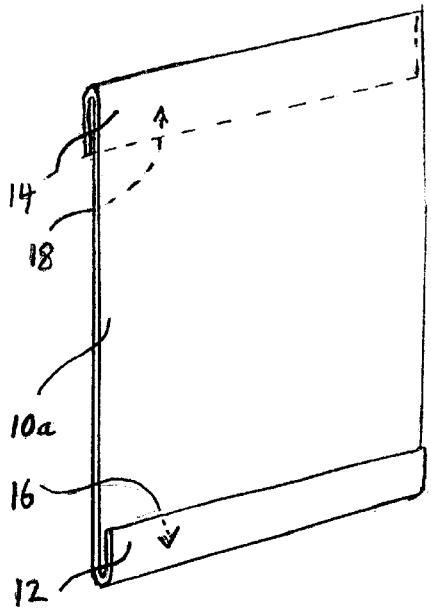
FIG. 1 is a perspective view of a plate according to a first embodiment of the present invention.
Figure 3:
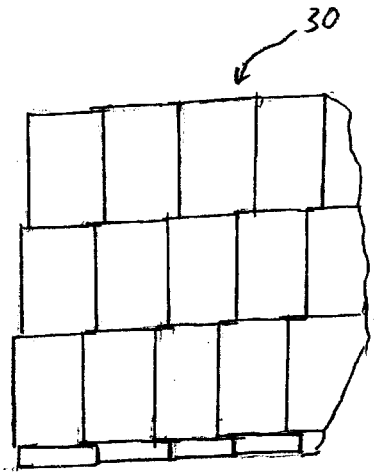
FIG. 3 is a partial front view of an array of interconnected plates of the type shown in FIG. 1.

FIG. 2 shows a schematic representation of an interconnection scheme for a plurality of plates 10*a*, 10*b*, 10*c*, 10*n*, 20*a* and 20*b*, each of the type shown in FIG. 1. By interconnecting plates according to the scheme of FIG. 2, structures of interconnected plates may be constructed in various sizes and shapes to accommodate a given building project. A portion of an example structure 30 of interconnected plates is shown in FIG. 3.

In FIG. 2, the plates are oriented such that the folded-over edges 12 and 14 are at the top and bottom of each plate. In the illustrated orientation, a first plurality of plates, composed of plates 10*a*, 10*b*, 10*c* and 10*n*, may be interconnected, side-by-side, by partially overlapping adjacent plates and fitting folded-over edges of plates into channels of adjacent plates.

Figure 4:
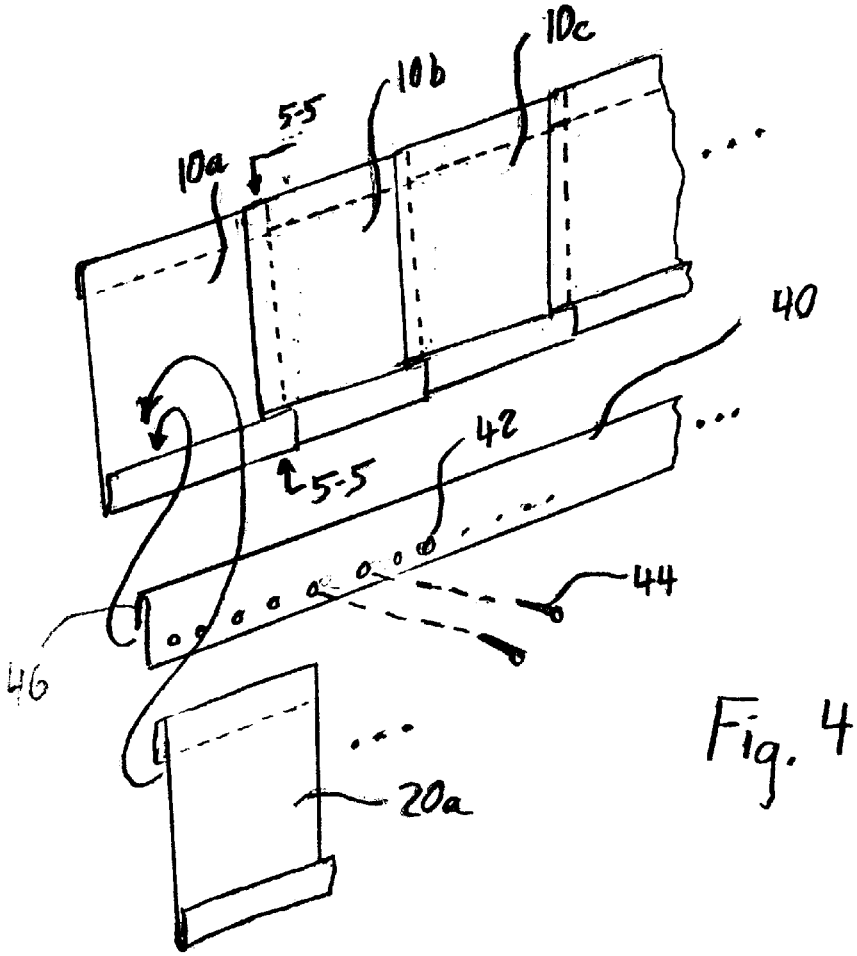
FIG. 4 is a schematic representation of a further interconnection scheme for a plurality of plates of the type shown in FIG. 1.
Figure 5:
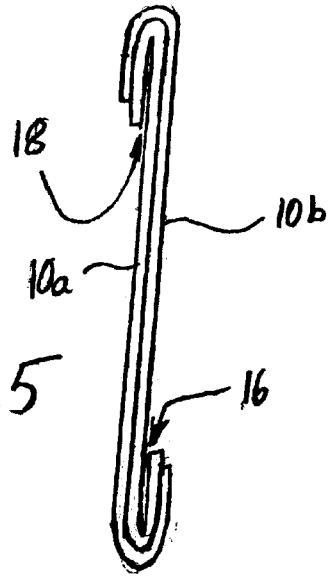
FIG. 5 is a cross-section view of overlapped portions of plates, as taken from 5—5 of FIG. 4.

More specifically, with reference to the orientation of the plates in FIGS. 2 and 4, plate 10*b* connects to plate 10*a*, by overlapping a portion of plate 10*a* with a portion of plate 10*b* and by inserting the bottom folded-over edge of plate 10*b* into the channel 16 of the bottom folded-over edge of plate 10*a*, while inserting the top folded-over edge of plate 10*a* into the channel 18 of the top folded-over edge of plate 10*b*. A cross-section view of the overlapped portions of plates 10*a* and 10*b* is shown in FIG. 5. The channels 16 and 18 formed by the folded-over edges may also interconnect with the folded-over edges of other components (such as edge 46 of the strip 40 and the upper edge of plate 20*a*, as described below, but not shown in FIG. 5).

Similarly, plate 10*c* connects to plate 10*b*, by overlapping a portion of plate 10*b* with a portion of plate 10*c* and by inserting the bottom folded-over edge of plate 10*c* into the channel 16 of the bottom folded-over edge of plate 10*b*, while inserting the top folded-over edge of plate 10*b* into the channel 18 of the top folded-over edge of plate 10*c*. Any number of plates may be similarly connected in the side-by-side arrangement, as represented by plate 10*n*. Preferably, the width of the channels 16 and 18, relative to the width of the folded-over edges, is selected to provide a friction fit of the folded-over edges into the channels and to provide a suitable degree of resistance to separation, once the folded-over edges are inserted into the channels. Plate materials having spring or elastic resilience characteristics, such as sheet metals as described above, may enhance the friction fit and the resistance to separation.

A second plurality of plates, as represented by plates 20*a* and 20*b* in FIG. 2, may be similarly interconnected together by overlapping plate 20*a* with plate 20*b* and by inserting the bottom folded-over edge of plate 20*b* into the channel of the bottom folded-over edge of plate 20*a*, while inserting the top folded-over edge of plate 20*a* into the channel of the top folded-over edge of plate 20*b*. Any number of plates may be similarly connected, side-by-side, in the second plurality of interconnected plates.

Figure 6:
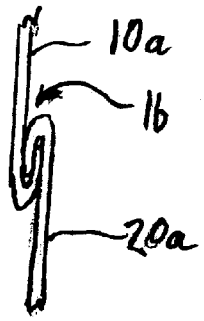
FIG. 6 is a cross-section view of a pair of folded-over plate edges, in an overlapped and interlocked orientation.

The second plurality of plates 20*a* and 20*b* may be interconnected to the first plurality of plates 10*a*, 10*b*, 10*c* and 10*n*, by overlapping the folded-over top edge of the second plates 20*a* and 20*b* with the bottom folded-over edges of the first plates in an interlocking manner, as shown in FIG. 6. In further embodiments, the folded-over edge 46 of a connecting strip 40 may be overlapped and interlocked into the channel 16, between the overlapping edges of plates 10*a* and 20*a*, as described below but not shown in FIG. 6. Preferably, the channel widths are selected to provide a friction fit between the overlapping folded-over edges and to provide a suitable degree of resistance to separation, once the folded-over edges are overlapped.

Further plates may be interconnected to the top or bottom edges, as well as the side edges of the array of interconnected plates, to add to and become part of the array. In this manner, arrays of interconnected plates may be configured in varieties of shapes and dimensions. FIG. 3 shows an array 30 of interconnected plates of the type shown in FIGS. 1 and 2.

Preferred configurations of the embodiment shown in FIGS. 1–3 include means for coupling an array 30 of interconnected plates to a further structure, such as, but not limited to, a roof, a wall, a frame or the like. According to one preferred configuration shown in FIG. 4, a connecting strip 40 is provided to connect the array to a further structure, but which may be hidden from view in the completed array 30 (FIG. 3).

The connecting strip 40 (FIG. 4) may be composed of any suitable material, including those described herein as suitable plate materials. The connecting strip 40 provides a fastening surface 42 to which one or more fastening devices 44, such as a nail, screw, bolt, or the like, may be secured, for securing the array to a further structure. The fastening surface may be provided with one or more apertures through which a screw, nail or bolt shaft may pass for securing the array to a further structure. The connecting strip has a folded-over edge 46 extending in its lengthwise dimension.

The connecting strip 40 connects to the array by overlapping the folded-over edge 46 of the connecting strip with the folded-over bottom (or top) edges of the first plurality of side-by-side interconnected plates 10*a*, 10*b*, 10*c*, and so forth. The connecting strip 40 is connected to the first plurality of plates and is secured to the further structure, prior to fitting the folded-over edges of the second plurality of plates 20*a*, 20*b* and so forth, into the channel 12. In this manner, the second plurality of plates 20*a*, 20*b* and so forth, when fitted into the channel, will cover some or all of the connecting strip from view.

Figure 7:
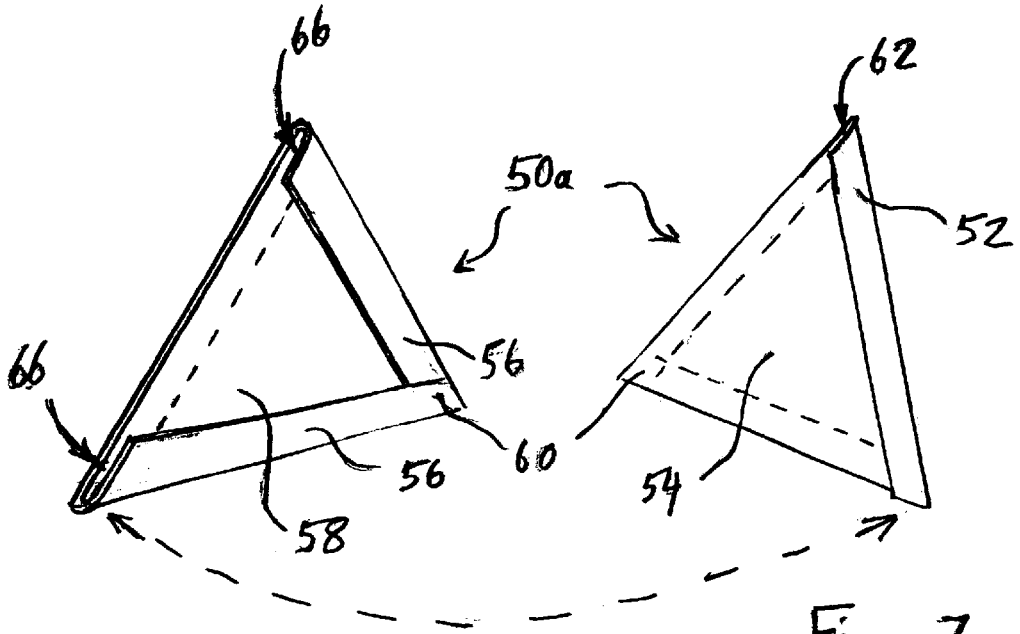
FIG. 7 is a perspective views of the two faces of a plate according to a second embodiment of the present invention.

A plate configuration and structures formed of such interconnected plates according to a second embodiment of the invention are shown and described with reference to FIGS. 7–12. A plate 50*a* according to the second preferred embodiment, as shown in FIG. 7, has a generally triangular configuration, with folded-over edges. More particularly, one "first" edge 52 of the triangular plate is folded over a first facing side 54 of the plate, while two "second" edges 56 of the triangular plate are both folded over the opposite facing side 58 of the plate. The second folded-over edges 56 overlap at one comer 60 of the plate. The folded-over edges that are hidden from view behind the plate are shown in broken lines in FIG. 7.

The folded-over edges form channels on each of the three edges and on opposite facing sides of the plate. More specifically, channels 62 and 66 are formed by folded-over edges 52 and 56, respectively.

Figure 8:
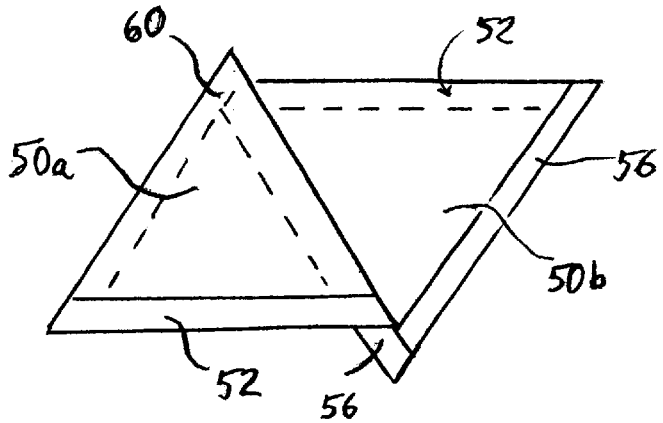
FIG. 8 is a schematic representation of an interconnection scheme for connecting two plates of the type shown in FIG. 7 into a first plurality of interconnected plates.
Figure 9:
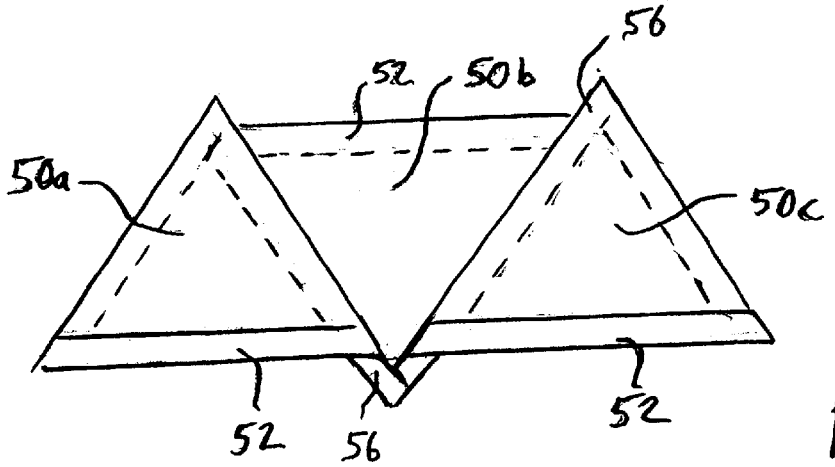
FIG. 9 is a schematic representation of an interconnection scheme for connecting a third plate of the type shown in FIG. 7 into the first plurality of interconnected plates.

FIGS. 8 and 9 show schematic representation of an interconnection scheme for a first plurality of plates 50*a*, 50*b* and 50*c*, each of the type shown in FIG. 7. In FIG. 8, one of the triangular plates 50*a* is oriented such that the first edge 52 (the only edge folded-over the first facing side 54 of the plate) defines the bottom edge. In the illustrated orientation, the plate 50*a* may be considered to be pointing upward relative to the first edge 52. Plate 50*b*, pointing downward relative to its first edge 52, is connected to the plate 50*b*, by overlapping one of the second folded-over edges 56 of the plate 50*b* with one the second folded-over edges 56 of the plate 50*a* in an interlocking manner (similar to the interlocking orientation of the folded-over edges shown in FIG. 6).

In FIG. 9, a further plate 50*c*, pointing upward relative to its first edge 52, is connected to plate 50*b*, by overlapping one of the second folded-over edges 56 of plate 50*c* with the second folded-over edge 56 of plate 50*b* that is shown free in FIG. 8. Additional plates may be added to the array in a similar fashion.

Figure 10:
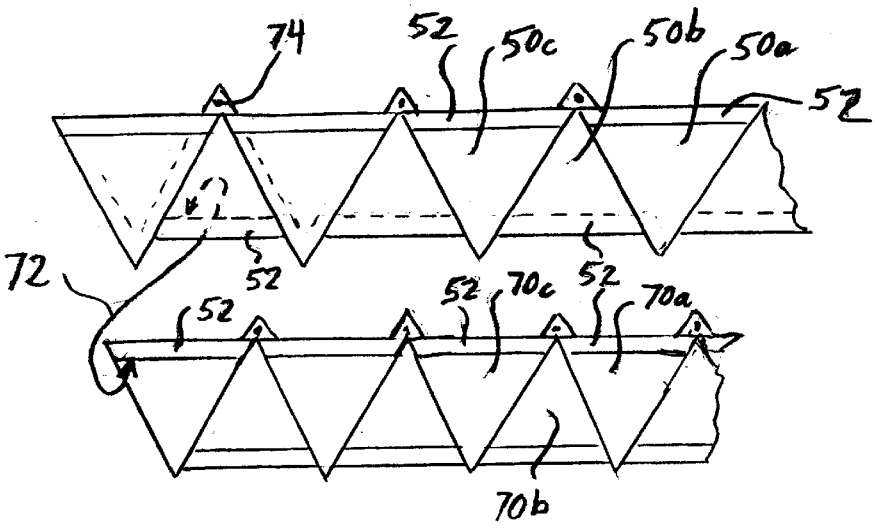
FIG. 10 is a schematic representation of an interconnecting scheme for connecting first and second pluralities of interconnected plates of the type shown in FIG. 7 into an array of interconnected plates.

Yet further plates may be coupled to the array by overlapping the folded-over first edges 52 of the further plates with the folded over first edges 52 of plates in the array. For example, FIG. 10 shows first and second arrays of interconnected plates, each formed as described above with respect to FIGS. 8 and 9. The first array of plates includes a plurality of plates 50*a*, 50*b*, 50*c* and so forth, each having a first folded-over edge 52 as described above. The second array of plates includes a plurality of plates 70*a*, 70*b*, 70*c*, and so forth, each also having a first folded-over edge 52 as described above.

Plates of the second array may be coupled plates of the first array, by overlapping the first folded-over edges 52 at the bottom of the first array with the first folded-over edges 52 at the top of the second array, as shown by arrow 72 in FIG. 10. In this manner, any number of plates may be coupled to the top or bottom edges of the first array. Moreover, any number of plates may be coupled together side-by-side in the first, second or further interconnected arrays. Accordingly, triangular plates may be interconnected in arrays of a varieties of shapes and dimensions.

Figure 12:
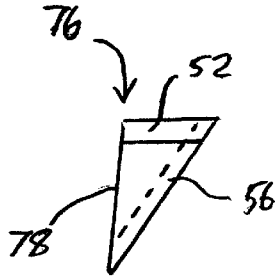
FIG. 12 is a schematic view of a plate configured for an outer edge of the structure of FIG. 11.
Figure 11:
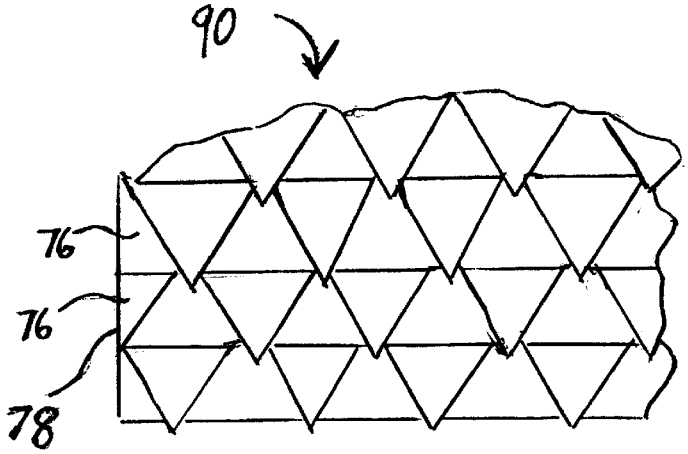
FIG. 11 is a partial front view of a structure formed of arrays of interconnected plates of the type shown in FIG. 7.

FIG. 11 shows a structure 90 formed of several interconnected arrays of triangular plates. As illustrated, when interconnected, the downward directed comers (with respect to the orientation shown in FIG. 11) of triangular plates of one array partially overlap a portion of the adjacent array below. Plates 76 defining the outer edge of the interconnected plate structure may be configured, as shown in FIG. 12, to provide a straight side edge 78 on the structure 90. With reference to FIG. 12, the plate 76 has a first folded-over edge 52, a single second folded-over edge 56 and a straight edge 78 forming an approximate right angle with the edge 52. The second folded-over edge 56 of plate 76 couples to a second folded-over edge 56 of another triangular plate in the array in the manner as described above. Similarly, the first folded-over edge 52 of the plate 76 couples to a first folded-over edge 52 of another triangular plate in the array (such as another plate 76) in the manner as described above.

Preferably, the width of the channels 62 and 66, relative to the width of the folded-over edges, is selected to provide a friction fit between overlapping folded-over edges and to provide a suitable degree of resistance to separation, once the folded-over edges are overlapped. Plate materials having spring or elastic resilience characteristics, such as sheet metals as described above, may enhance the friction fit and the resistance to separation.

Preferred configurations of the second embodiment also include means for coupling an array of interconnected plates to a further structure, such as, but not limited to, a roof, a wall, a frame or the like. According to one preferred configuration, a fastening surface is provided adjacent the comer 60 between the two second edges 56 of at least some of the triangular plates. Fastening devices (not shown in FIG. 10), such as, but not limited to, nails, screws, bolts or the like, may be secured to the fasting surface, for securing the array to a further structure. For example, one or more apertures 74 may be provided in the fastening surfaces, through which a screw, nail or bolt shaft may pass.

In accordance with each of the above embodiments, arrays of interconnected plates may be configured to the dimensions of, for example, roofs or walls, to form decorative and/or protective roofing or wall panels. As another representative example, arrays of interconnected plates may be configured to the dimension of awnings to form decorative and/or protective awning coverings. In yet further examples, arrays of plates may be interconnected to form decorative, artistic sculptures. The overlapping arrangement of the plates, when interconnected, can provide an aesthetically pleasing design, as well as a protective covering for a roof, wall or other structure.

Accordingly, embodiments of the invention include systems composed of a plurality of interconnectable plates configured as described above. Further embodiments of the invention include structures formed of systems of interconnected plates as described above. Yet further embodiments of the invention include processes of making and using systems of interconnected plates as described above.

The foregoing description of the preferred embodiment of the invention has been presented for the purposes of illustration and description. It is not intended to be exhaustive or to limit the invention to the precise form disclosed. Many modifications and variations are possible in light of the above teaching. For example, while the above embodiments employ non-square rectangular plates or triangular plates, other embodiments employ square plates, trapezoid-shaped plates, right triangle-shaped plates or other suitable plate shapes. In some embodiments, arrays of interconnected plates may include plates of different shapes or dimensions, even within the same interconnected plate structure. As a result, embodiments of the present invention provide a significant degree of flexibility with respect to the shape and dimension of the structures that may be formed by the interconnected plates.

What is claimed is:

1. A building system comprising:

a first group of generally triangular shaped plates, each plate having first and second opposite facing surfaces, a first edge folded-over toward the first surface and two second edges folded-over toward the second surface, wherein the first and second folded-over edges define first and second channels, respectively;

wherein each given plate in the first group is configured to connect with any other plate in the first group by interlocking a second folded-over edge of the given plate with a second folded-over edge of the other plate such that a portion of the second folded-over edge of the given plate is received in the channel defined by the second folded-over edge of the other plate, and a portion of the second folded-over edge of the other plate is received in the channel defined by the second folded-over edge of the given plate; and wherein the first and second channels are dimensioned to provide a friction fit between the folded-over edge of the plates upon receipt of the folded-over edges within the channels.

2. A building system as recited in claim 1, wherein at least one of the plates in the first group includes a fastening surface located adjacent a comer between the two second folded-over edges of the plate, for engaging a fastening device.

3. A building system as recited in claim 1, further comprising:

a fastening surface located adjacent a comer between the two second folded-over edges of at least one of the plates in the first group; and a fastening device for engaging the fastening surface.

4. A building system as recited in claim 1, further comprising:

a second group of plates, each plate in the second group having first and second opposite facing surfaces, a first edge folded-over toward the first surface and two second edges folded-over toward the second surface, wherein the first and second folded-over edges define first and second channels, respectively;

wherein each given plate in the second group is configured to connect with any other plate in the second group by interlocking a second folded-over edge of the given plate with a second folded over edge of the other plate such that a portion of the second folded-over edge of the given plate is received in the channel defined by the second folded-over edge of the other plate, and a portion of the second folded-over edge of the other plate is received in the channel defined by the second folded-over edge of the given plate;

wherein each given plate in the second group is configured to connect with any given plate in the first group by interlocking the first folded-over edge of the given plate in the second group with the first folded-over edge of the given plate in the first group, such that a portion of the first folded-over edge of the given plate in the first group is received in the channel defined by the first folded-over edge of the given plate in the second group, and a portion of the first folded-over edge of the given plate in the second group is received in the channel defined by the first folded-over edge of the given plate in the first group; and wherein the first and second channels are dimensioned to provide a friction fit between the folded-over edge of the plates upon receipt of the folded-over edges within the channels.

5. A building system as recited in claim 4, wherein each plate in the second group of plates is generally triangular shaped.

6. A building system as recited in claim 4, wherein a plurality of the plates in the first and second groups each include a fastening surface located adjacent a corner between the two second folded-over edges of the plate, for engaging a fastening device.

7. A building process comprising:

providing a first group of generally triangular shaped plates, each plate having first and second opposite facing surfaces, a first edge folded-over toward the first surface and two second edges folded-over toward the second surface, wherein the first and second folded-over edges define first and second channels, respectively;

connecting each given plate in the first group with another plate in the first group by receiving a portion of the second folded-over edge of the given plate in the channel defined by the second folded-over edge of the other plate, while receiving a portion of the second folded-over edge of the other plate in the channel defined by the second folded-over edge of the given plate; and wherein the first and second channels are dimensioned to provide a friction fit between the folded-over edge of the plates upon receipt of the folded-over edges within the channels.

8. A building process as recited in claim 7, wherein the process further comprises engaging a fastening device with a fastening surface located adjacent a corner between the two second folded-over edges of the plate of at least one of the plates in the first group.

9. A building process as recited in claim 7, wherein the process further comprises fastening at least one of the plates of the first group to a at least one of a roof, frame or wall, with at least one fastening device engaged with a fastening surface located adjacent a corner between the two second folded-over edges of the at least one plate.

10. A building process as recited in claim 7, wherein the process further comprises:

providing a second group of plates, each plate in the second group having first and second opposite facing surfaces, a first edge folded-over toward the first surface and two second edges folded-over toward the second surface, wherein the first and second folded-over edges define first and second channels, respectively;

connecting each given plate in the second group with another plate in the second group by receiving a portion of the second folded-over edge of the given plate in the channel defined by the second folded-over edge of the other plate, while receiving a portion of the second folded-over edge of the other plate in the channel defined by the second folded-over edge of the given plate; and connecting each given plate in the second group with a given plate in the first group by receiving a portion of the first folded-over edge of the given plate in the first group in the channel defined by the first folded-over edge of the given plate in the second group, while receiving a portion of the first folded-over edge of the given plate in the second group in the channel defined by the first folded-over edge of the given plate in the first group;

wherein the first and second channels are dimensioned to provide a friction fit between the folded-over edge of the plates upon receipt of the folded-over edges within the channels.

11. A building process as recited in claim 10, wherein each plate in the second group of plates is generally triangular shaped.

12. A structure of plates made according to the process of claim 7.

13. A building system as recited in claim 1, wherein upon a given plate in the first group being connected with said other plate in the first group, the apex of the given plate is directed opposite to the apex of said connected other plate.

14. A building system as recited in claim 7, wherein upon connecting a given plate in the first group with said other plate in the first group, the apex of the given plate is directed opposite to the apex of said connected other plate.

* * * * *